US007168448B2

(12) United States Patent
Schmidt

(10) Patent No.: US 7,168,448 B2
(45) Date of Patent: Jan. 30, 2007

(54) EXHAUST-STEAM PIPELINE FOR A STEAM POWER PLANT

(75) Inventor: Markus Schmidt, Herten (DE)

(73) Assignee: GEA Energietechnik GmbH, Bochum (DE)

( * ) Notice: Subject to any disclaimer, the term of this patent is extended or adjusted under 35 U.S.C. 154(b) by 129 days.

(21) Appl. No.: 11/086,970

(22) Filed: Mar. 22, 2005

(65) Prior Publication Data

US 2005/0161094 A1 Jul. 28, 2005

Related U.S. Application Data

(63) Continuation of application No. PCT/DE04/01417, filed on Jul. 2, 2004.

(51) Int. Cl.
*F02B 9/02* (2006.01)

(52) U.S. Cl. ..... 137/561 A; 137/561 R; 261/DIG. 76

(58) Field of Classification Search ..... 137/561 R, 137/561 A; 261/DIG. 76
See application file for complete search history.

(56) References Cited

U.S. PATENT DOCUMENTS

| | | | | |
|---|---|---|---|---|
| 2,164,011 | A * | 6/1939 | Hilborn | 137/561 A |
| 2,723,680 | A * | 11/1955 | Francois | 137/561 A |
| 3,037,629 | A * | 6/1962 | Dreissen et al. | 137/561 R |
| 3,103,942 | A * | 9/1963 | Sharp | 137/561 R |
| 3,794,056 | A * | 2/1974 | Warren | 137/561 A |
| 3,814,177 | A | 6/1974 | Harris et al. | |
| 4,574,837 | A * | 3/1986 | Aggour et al. | 137/561 A |
| 4,593,653 | A * | 6/1986 | Schneider et al. | 137/561 A |
| 4,609,009 | A * | 9/1986 | Tisone | 137/561 A |
| 4,782,857 | A * | 11/1988 | Bieri | 137/561 A |
| 4,800,921 | A * | 1/1989 | Greebe | 137/561 A |
| 4,824,614 | A * | 4/1989 | Jones | 137/561 A |
| 5,407,274 | A * | 4/1995 | Woerheide et al. | 137/561 A |
| 5,709,468 | A * | 1/1998 | Woerheide et al. | 137/561 A |

FOREIGN PATENT DOCUMENTS

| | | | |
|---|---|---|---|
| DE | 1 082 286 B | | 5/1960 |
| DE | 1 945 314 A | | 3/1971 |
| DE | 2 421 681 A | | 11/1974 |
| FR | 2 338 472 A | | 8/1977 |
| SU | 1108118 A | * | 8/1984 |

* cited by examiner

*Primary Examiner*—John Rivell
(74) *Attorney, Agent, or Firm*—Henry M. Feiereisen

(57) ABSTRACT

An exhaust steam pipeline for steam power plants includes a main steam line and at least two branch lines which are fluidly connected to respective condenser elements of the steam power plant and branch off from the main steam line at connection zones in spaced-apart relationship. The main steam line has a cross section, which decreases following each of the connection zones, and is constructed to ascend at an angle to a horizontal in flow direction of the exhaust steam.

14 Claims, 4 Drawing Sheets

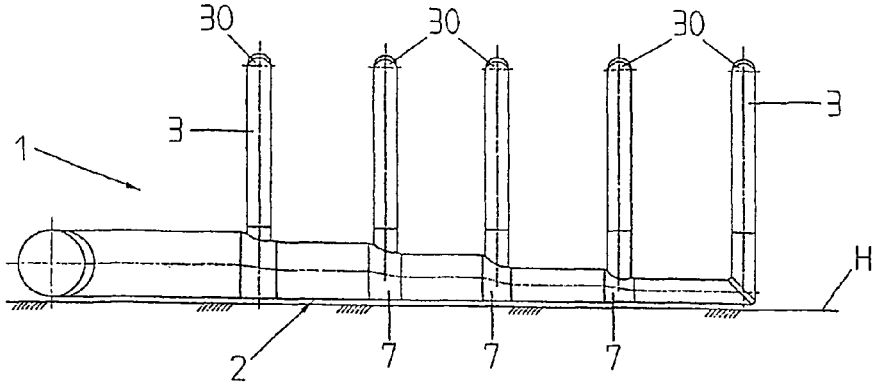
Fig. 1
Prior Art
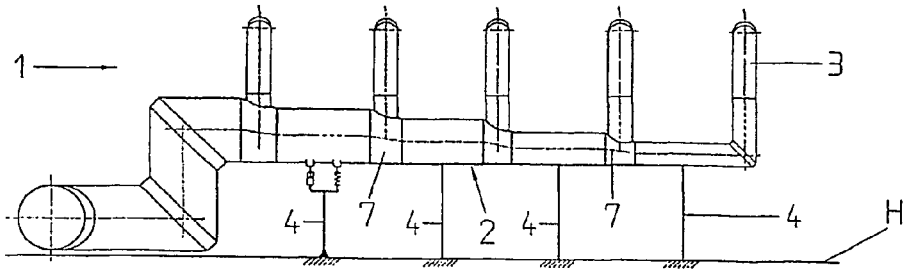
Fig. 2
Prior Art
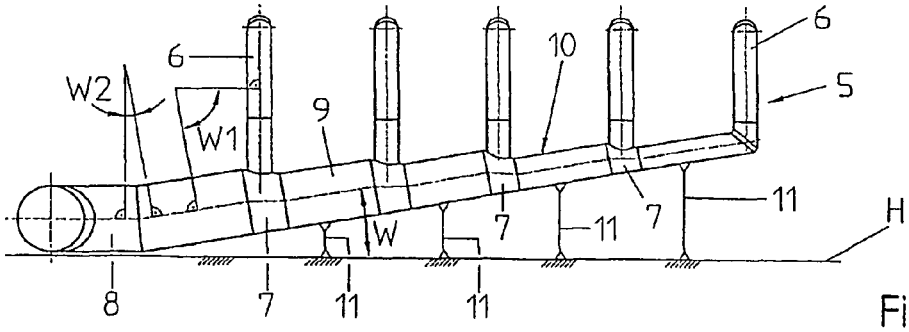
Fig. 3.1
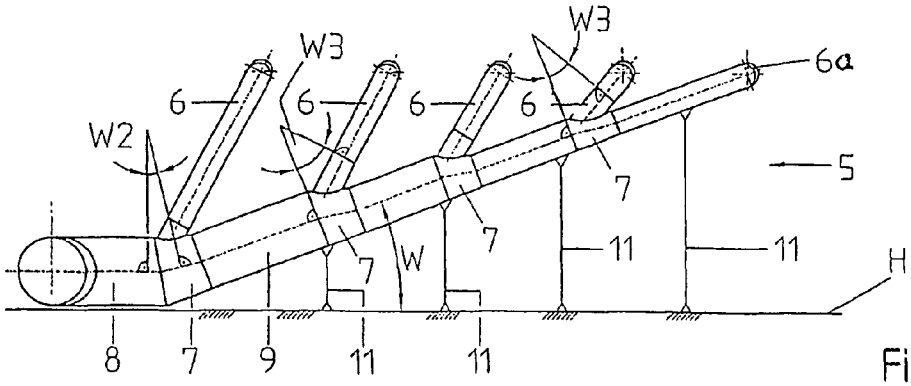
Fig. 3.2

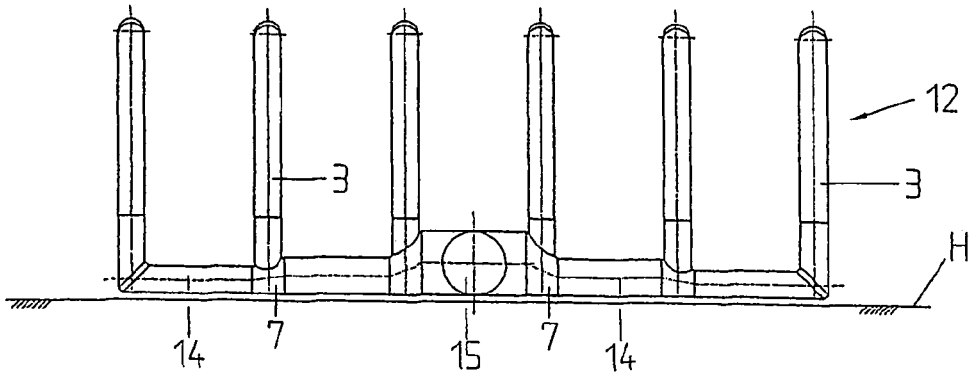
Fig. 4
Prior Art
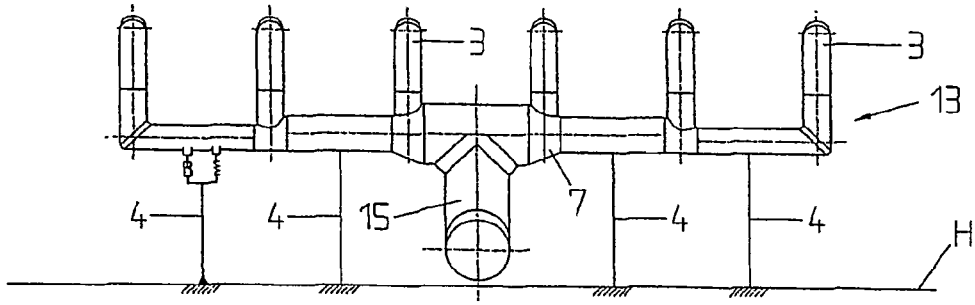
Fig. 5
Prior Art
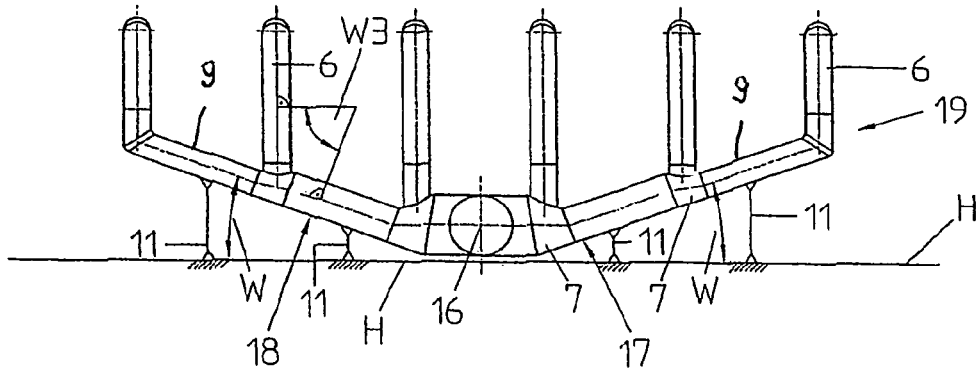
Fig. 6.1
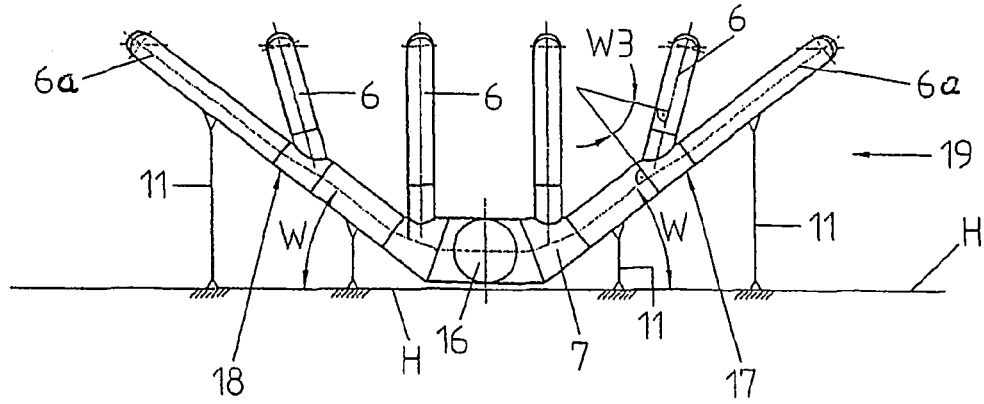
Fig. 6.2

EXHAUST-STEAM PIPELINE FOR A STEAM POWER PLANT

CROSS-REFERENCES TO RELATED APPLICATIONS

This application is a continuation of prior filed copending PCT International application no. PCT/DE2004,001417, filed Jul. 2, 2004, which designated the United States and on which priority is claimed under 35 U.S.C. §120, and which claims the priority of German Patent Application, Serial No. 103 30 659.5, filed Jul. 8, 2003, pursuant to 35 U.S.C. 119(a)–(d).

BACKGROUND OF THE INVENTION

The present invention relates, in general, to an exhaust-steam pipeline for a steam power plant.

An exhaust-steam pipeline for a steam power plant, in particular steam turbine, is intended to carry exhaust steam from the outlet of the steam turbine via a main steam line to branch lines by which the exhaust steam is directed to individual condenser elements. This process is executed mainly under vacuum conditions. The exhaust-steam pipeline for an air-cooled condenser normally has a diameter between 1 m and 10 m. The presence of local flow losses have been experienced within the exhaust-steam pipeline as a consequence of a local change in the flow cross section or flow direction. Despite the stepped decrease in the pipeline cross section at the connection zone of the branch line, a pressure drop occurs in conventional exhaust-steam pipelines at the port of the branch line as a result of the exhaust steam flowing freely past this port.

German Pat. Publication No. 1 945 314 discloses an exhaust-steam pipeline which attempts to reduce the pressure drop at the branching points of the branch lines by reducing the pipeline cross section by using two pipe pieces of different diameter which are nested within one another and suitably sealed off whereby the smaller pipe piece is sufficiently pushed into the greater pipe piece to form a ring space and to cover the connection port of the branch line in radial direction in the greater pipe piece. A drawback of this construction is the inability to decrease the pressure drop beyond a certain level. Losses are typically experienced in the area of the connection zones, when the flow of exhaust steam is deflected. These flow losses are in addition to the pressure drops as encountered along the pipeline.

When the main steam line extends horizontally near the bottom, the upwardly extending branch lines-must be constructed long enough. FIG. 1 shows such a prior art exhaust-steam pipeline 1 with a horizontal main steam line 2 and branch lines 3 extending vertically upwards from the main steam line 2. Distribution pipes 30 of unillustrated condenser elements are fluidly connected to the upper ends of the branch lines 3. In this construction, the branch lines 3 are not only very long but must also be appropriately supported along their length dimension. As thermal length fluctuations must be compensated, the provision of compensators in the branch lines 3 is required to position the individual portions of the branch lines 3 at proper orientation on the unillustrated steel framework. This complicates the installation. The overall length of the pipeline is relatively long so that substantial tonnage needs to be transported which in turn also complicates the assembly. Also, accessibility is impeded and requires oftentimes covering of very long distances as any direct path is blocked by the bottom-proximal main steam line 2.

Therefore, it has been proposed to elevate the horizontal main steam line to thereby shorten the individual branch lines, as shown in FIG. 2. While the weight of the branch lines 3 is lighter despite the integration of compensators, this approach requires the integration of at least two 90° bends in the main steam line 1 to conduct the exhaust steam, exiting in horizontal direction, into the vertical length portion, and from there again into a horizontal length portion. These 90° deflections require the installation of guide vane elbows within the bends in order to reduce the drag coefficient. When larger plants are involved, the mass of the elbows becomes very high and can reach 7 to 20 t that needs to be supported. Thus, this great mass no only complicates the assembly but poses also a problem in connection with earthquakes. In view of the great mass of the horizontal length portion of the main steam line including the guide vane elbows in the transition area to the vertical length portion of the main steam line, it is necessary to provide particular support structures in regions that are especially prone to earthquakes in order to absorb vertically acting shocks.

Typically, the use of spring supports 4 is proposed to compensate for heat-triggered length changes to thereby provide a sufficient support of the horizontal length portion of the main steam line. This involves, however, the risk that in the event of vertical shocks caused by an earthquake the spring supports are incapable to absorb the relatively great mass of the main steam line and the guide vane elbow. Thus, there is a need for providing additional dashpots in the form of hydraulic dampers. These dashpots in combination with the springs of the spring supports 4 provide a spring-damper assembly to prevent a propagation of forces triggered by an earthquake from the main steam line 2 to the steam turbine on which the main steam line 2 is, in fact, attached. The spring supports 4 together with the dashpots constitute relatively complicated components which have to be repeatedly installed along the length of the main steam line 2 in order to ensure an even elevating and lowering of the horizontal length portion of the main steam line 2. FIG. 2 shows schematically the further spring supports 4 by way of doubly breached lines.

FIGS. 4 and 5 show further prior art exhaust steam pipelines 12, 13 which essentially correspond to the constructions of FIGS. 1 and 2, with the difference residing in the arrangement of four to twelve branch lines 3 which are respectively connected via transverse branches of the main steam line 14 to a central duct 15. FIG. 5 shows the elevated disposition of the exhaust-steam pipeline 13 with spring supports 4, as described in connection with FIG. 2.

It would be desirable and advantageous to provide an improved exhaust-steam pipeline which obviates prior art shortcomings and which is easy to install while yet keeping a pressure drop to a minimum.

SUMMARY OF THE INVENTION

According to one aspect of the present invention, an exhaust-steam pipeline for a steam power plant includes a main steam line carrying exhaust steam and having at least two branch lines which are fluidly connected to condenser elements of the steam power plant and branch off from the main steam line at connection zones in spaced-apart relationship, with the main steam line having a cross section, which decreases following each of the connection zones, and being constructed to ascend at an angle to a horizontal in flow direction of the exhaust steam.

The present invention resolves prior art problems by providing a substantial direct link between the connection of the main steam line at the lower end and several connections of the branch lines to the distribution pipes at a higher level. The upward inclination of the main steam line has the advantage that the individual branch lines, although of different lengths, can be designed shorter overall compared to horizontal main steam lines. As a consequence, the length of the flow path is reduced overall.

The reduced material use results in lower weight of the main steam line and thus also in cost-savings and simpler installation. The installation can be realized at cost-savings because the branch lines composed of individual ring segments, can be made shorter and thus constructed with less welding operations for joining the ring segments. As the total weight is smaller, handling becomes easier. Also, the foundation is exposed to smaller loads and thus can be made smaller.

Another advantage of an exhaust-steam pipeline according to the present invention compared to rectangularly designed arrangements between the main steam line and the branch lines resides in the decrease of flow losses that cause pressure drops. The pressure drop is proportional to the drag coefficient of the pipeline system, with the drag coefficient being primarily dependent on the number and configuration of elbows and pipe branches. The drag coefficient is reduced in the area of the connection zones of the branch lines by the slanted disposition of the main steam line. In general, the drag coefficient decreases with decreasing angle of disposition of the branch lines. The angle of disposition is determined between the cross sectional plane of the main steam line and the cross sectional plane of a branch line. While the angle of disposition is 0°, when the cross sectional planes are parallel, the typical angle of disposition of 90° is reduced in accordance with the present invention by the angle of inclination of the main steam line, so that smaller drag coefficients are experienced at each connection zone of a branch line in comparison to a 90° deflection. The overall loss becomes substantially smaller and also smaller pressure drop is encountered within the main steam line compared to rectangularly designed configurations.

Suitably, the ascent of the main steam line from the lower end of the steam turbine is gentle, e.g. at an angle of disposition ranging from 5° to 60°. Currently preferred is an angle of disposition ranging from 10° to 20°. Greater angles may result in a greater drag coefficient in the transition zone from the horizontal length portion of the main steam line to the inclined length portion of the main steam line, thereby causing greater pressure drops early on. In particular at very small angles of disposition, in particular angle of disposition of below 10°, the drag coefficient is much smaller, compared to typical 90° elbows. Moreover, the need for additional deflection devices such as, e.g., guide vane elbows, is eliminated, thereby significantly simplifying the overall construction. The recirculation of condensate in opposition to the steam flow direction is better in the main steam line.

The selection of the angle of disposition depends on the length of the main steam line and the respective plant conditions. The change in elevation of the main steam line is realized in the absence of a 90° bend within the pipeline by an angling that is significantly smaller than 90°.

According to another feature of the present invention, the main steam line may be split in two main steam line portions which are connected to a center duct from opposite sides with opposing ascent. As a result, the main steam line portions exhibit together a substantially V-shaped configuration with central exhaust steam feed.

According to another feature of the present invention, at least one of the branch lines ascends slantingly at an angle relative to the main steam line in flow direction of the exhaust steam. In other words, the upper ends of the branch lines and their connection zones do not lie in a same vertical plane. This configuration further reduces flow losses at the individual connection zones.

According to another feature of the present invention, the one of the branch lines disposed at the outermost end of the main steam line has an orientation which is the same as an orientation of the main steam line. In this context the term "same orientation" is to be understood as relating to a parallelism or coincidence of the longitudinal axis of the main steam line and the branch line. The angle of the main steam line in relation to the horizontal is mainly determined by the horizontal and vertical distances of the last condenser element of the turbine. As the main steam line merges into the terminal branch line in the absence of a bend, the main steam line can be configured respectively shorter. The overall weight is thus further decreased despite the longer design of the last branch line.

According to another feature of the present invention, at least one of the branch lines may divide in at least two partial lines at a connection zone. As a consequence, the flow of exhaust steam through the branch line is split into two partial streams to flow to two condenser elements respectively. When particular geometric conditions are involved, the division of the branch line into two partial lines is preferred to the provision of a further branch line which has to be directly connected to the main steam line. The added branching of the branch line in two or more partial lines allows a further material saving and decrease of the overall weight. Suitably, at least one of the partial lines ascends slantingly at an angle of disposition in relation to the branch line. In this way, flow losses are kept to a minimum. The angle of disposition is hereby significantly smaller than 90°.

According to another feature of the present invention, a baffle plate may be disposed in an area of a connection zone of a branch line or partial line for dividing the flow of exhaust steam in partial streams. The baffle plate is intended to split the exhaust steam flow at smallest possible pressure drop. Suitably, the pressure drops are identical in each of the partial lines that carry exhaust steam.

According to another feature of the present invention, the ratio of the partial exhaust steam flows corresponds to a ratio of the distribution pipes following a connection zone. In the event, five branch lines branch off, for example, from the main steam line, whereby a same amount of exhaust steam is fed to the individual distribution pipes, it is necessary to branch off one-fifth of the exhaust stream flow in the connection zone that is first in flow direction. At the next connection zone, one-fourth of the reduced exhaust steam flow needs to be branched off, and one third and one half at the following connection zones. When a branch line is split in two partial lines which connect each to a distribution pipe, twice the exhaust steam quantity is to be supplied to the respective branch line.

According to another feature of the present invention, a support assembly may be provided for supporting the main steam line, with the support assembly having a compensation device for compensating thermal; length changes of the main steam line. Examples of a compensation device include a rocking member or a sliding member.

The inclined construction of the main steam line results in an improved supply of cooling air underneath the condenser elements, thereby enabling, depending on the arrangement, the provision of a lower platform height and thus a reduction of the steel construction costs. Moreover, accessibility to the plant is enhanced as the area underneath the main steam line is clear.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a schematic illustration of a prior art exhaust steam pipeline for air-cooled condensers;

FIG. 2 is a schematic illustration of another prior art exhaust steam pipeline for air-cooled condensers;

FIG. 3.1 is a schematic illustration of one embodiment of an exhaust steam pipeline according to the present invention;

FIG. 3.2 is a schematic illustration of another embodiment of an exhaust steam pipeline according to the present invention;

FIG. 4 is a schematic illustration of another prior art exhaust steam pipeline with central exhaust steam supply;

FIG. 5 is a schematic illustration of yet another prior art exhaust steam pipeline with central exhaust steam supply;

FIG. 6.1 is a schematic illustration of a first variation of an exhaust steam pipeline according to the present invention in V-shaped configuration and central exhaust steam supply;

FIG. 6.2 is a schematic illustration of a second variation of an exhaust steam pipeline according to the present invention in V-shaped configuration and central exhaust steam supply;

DETAILED DESCRIPTION OF PREFERRED EMBODIMENTS

Figure 7:
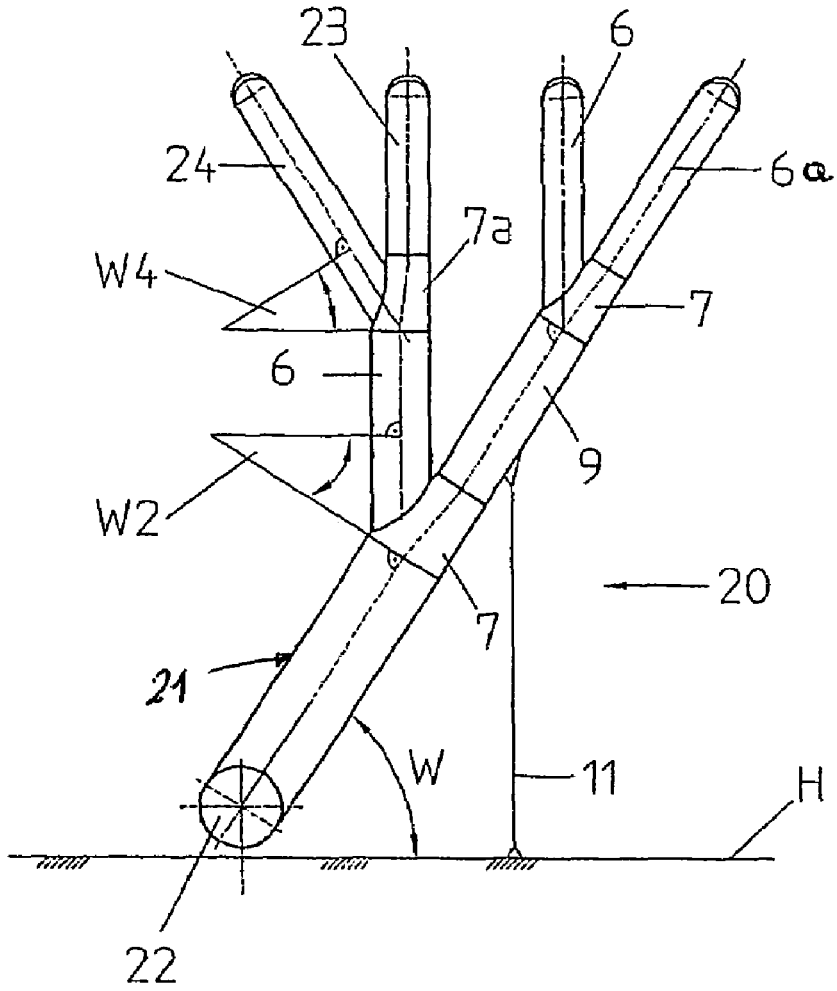
FIG. 7 is a schematic illustration of yet another embodiment of an exhaust steam pipeline according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 3.1, there is shown a schematic illustration of one embodiment of an exhaust steam pipeline according to the present invention, generally designated by reference numeral 5 and including a main steam line 10 which carries exhaust steam and extends slantingly upwards at an angle W in relation to the horizontal H from a horizontal length portion 8 in flow direction of the exhaust steam. In the non-limiting example of FIG. 3.1, the angle of ascent W is 10°. Connected to the main steam line 10 are five branch lines 6 which extend vertically upwards from the main steam line 10. The main steam line 10 narrows hereby in cross section following each connection zone 7 between the branch lines 6 and the main steam line 10, with the main steam line 10 thus having length portions 9 of different diameter between the connection zones 7 to the branch lines 6. As a result of the inclined construction of the main steam line 10, the right-most branch line 6 in FIG. 3.1 is significantly shorter than the left-most branch line 6, and the angle of disposition W1 between the length portions 9 and the following branch lines 6 is smaller than 90°. In the non-limiting example of FIG. 3.1, the angle of disposition W1 is 80°, so that the drag coefficient of the branch lines is smaller compared to 90° bends.

Also, the angle of disposition W2 between the horizontal length portion 8 and the following ascending length portion 9 is small enough to cause only a very slight drag coefficient within the curved area so that the installation of a guide vane elbow is no longer required. Exhaust steam may be supplied to the unillustrated condenser elements on the upper ends of the branch lines 6, when the overall length of the pipeline is reduced, without using guide vane elbows, while at the same time pressure losses are reduced.

The ascending length portions 9 of the main steam line 10 is supported on self-aligning supports 11 which compensate for thermal length fluctuations in length direction of the ascending length portions 9. The need for complicated spring supports and dashpots is eliminated. In the event of an earthquake and resultant vertical forces, the ascending main steam line 10 does not subject the steam turbine to inadmissible forces so that the exhaust steam pipeline 5 is much easier to install. The ascending course of the main steam line 10 allows a free air circulation underneath the platform of the air-cooled condenser elements, and provides better accessibility to the entire plant as a path underneath the main steam line 10 is clear. In addition, the exhaust steam pipeline 5 exhibits smaller attack areas during wind exposure compared to the prior art constructions.

FIG. 3.2 shows a schematic illustration of another embodiment of an exhaust steam pipeline 5 according to the present invention. Parts corresponding with those in FIG. 3.1 are denoted by identical reference numerals and not explained again. The description below will center on the differences between the embodiments. In this embodiment, the branch lines 6, rather than extending in vertical relationship to the horizontal, extend here slantingly upwards. The ascent of the length portions 9 of the main steam line 10 or angle of ascent W is so selected that the right-most branch line, labeled 6*a*, at the outer end of the main steam line 10 has a same orientation as the main steam line 10. Although the angle W in relation to the horizontal is greater than the angle W in the embodiment of FIG. 3.1 and thus results in slightly higher flow losses in the transition area from the horizontal length portion 8 to the ascending length portion 9, the angle of disposition W3 between the length portions 9 and the branch lines 6 is smaller than in the embodiment of FIG. 3.1 so that individually as well as overall the flow losses at the connection zones 7 of the branch lines 6 are significantly smaller. Thus, the cross section of the main steam line 10 can be dimensioned progressively smaller in the length portions 9, resulting in substantial material and cost savings as well as reduced weight and reduced assembly costs. In addition, stress is also reduced as a result of wind and earthquake, and the loads as a result of own weight and loads on the foundation are decreased.

Each length portion 9 of the ascending main steam line 10 between two connection zones 7 is borne by a support 11. The angles of disposition W3 may also deviate from one another. For example, it may be desirable to progressively flatten the angle of disposition W3 in the direction toward the outer end of the main steam line 10 or even make the angle of disposition W3 become zero, as shown in FIG. 3.2.

Turning now to FIG. 6.1, there is shown a schematic illustration of an exhaust steam pipeline according to the present invention, generally designated by reference numeral 19 and constructed to exhibit a V-shaped configuration. The exhaust steam pipeline 19 includes a central exhaust steam supply duct 16 and two main steam lines 17, 18 which are fluidly connected to the central supply duct 16 on opposite sides and have opposite ascent. The main steam lines 17, 18 are borne by supports 11, in particular self-aligning supports. This embodiment of an exhaust steam pipeline has the same advantages as set forth in connection with the embodiment of the exhaust steam pipeline 5 of FIG. 3.1.

It will be understood by persons skilled in the art that it is, of course, conceivable to replace the self-aligning supports 11 by fixed supports having a sliding base of Teflon and special steel.

FIG. 6.2 shows a schematic illustration of another embodiment of an exhaust steam pipeline 19 according to the present invention. Parts corresponding with those in FIG. 6.1 are denoted by identical reference numerals and not explained again. The description below will center on the differences between the embodiments. In this embodiment, the angle of ascent W between the horizontal H and the main steam lines 17, 18 is greater than in the embodiment of FIG. 6.1. The angle W is selected such that the last or right-most branch line 6*a* is in alignment with the main steam line 17, 18. In other words, the outermost branch lines 6*a* become in fact a component of the main steam lines 17, 18, respectively. A further difference resides in the slanted disposition of the middle branch lines 6 in relation to the horizontal H. The angle of disposition between the main steam lines 17, 18 and the middle branch lines 6 is designated by reference character W3 which is significantly less than 90° and even further reduced compared to the embodiment of FIG. 6.1. Also in the embodiment of FIG. 6.2, stress is reduced as a result of wind and earthquake, and the loads as a result of own weight and loads on the foundation are decreased. In addition, the assembly as a result of reduced weight is also easier.

Referring now to FIG. 7, there is shown a schematic illustration of yet another embodiment of an exhaust steam pipeline according to the present invention, generally designated by reference numeral 20 having a main steam line 21 which extends slantingly upward with respect to the horizontal H at an angle W which is much steeper here. The main steam line 21 is connected to a central duct 22 in the absence of a horizontal length portion. The angle W is selected such that the last or outermost branch line 6*a* is in alignment with the main steam line 21. As a result of the relatively steep ascent of the main steam line 21, the angle of disposition W2 between the vertical branch lines 6 and the main steam line 21 is small so that flow losses in the connection zones 7 of the main steam line 21 are slight. As further shown in FIG. 7 by way of example, the first or left-most branch 6 is divided in two partial lines 23, 24, which lead to respective unillustrated condenser elements. This branch line 6 extends from the main steam line 21 vertically upwards to a connection zone 7*a* from where the partial line 24 branches off at an angle of disposition W4, whereas the partial line 23 continues in vertical alignment of the branch line 6. The provision of the partial line 24 saves the need for arrangement of a separate branch line that has to be connected to the main steam line 21. In particular, when the main steam line 21 ascends at a very steep angle, the added provision of such partial lines to divide branch lines is desired.

Figure 8:
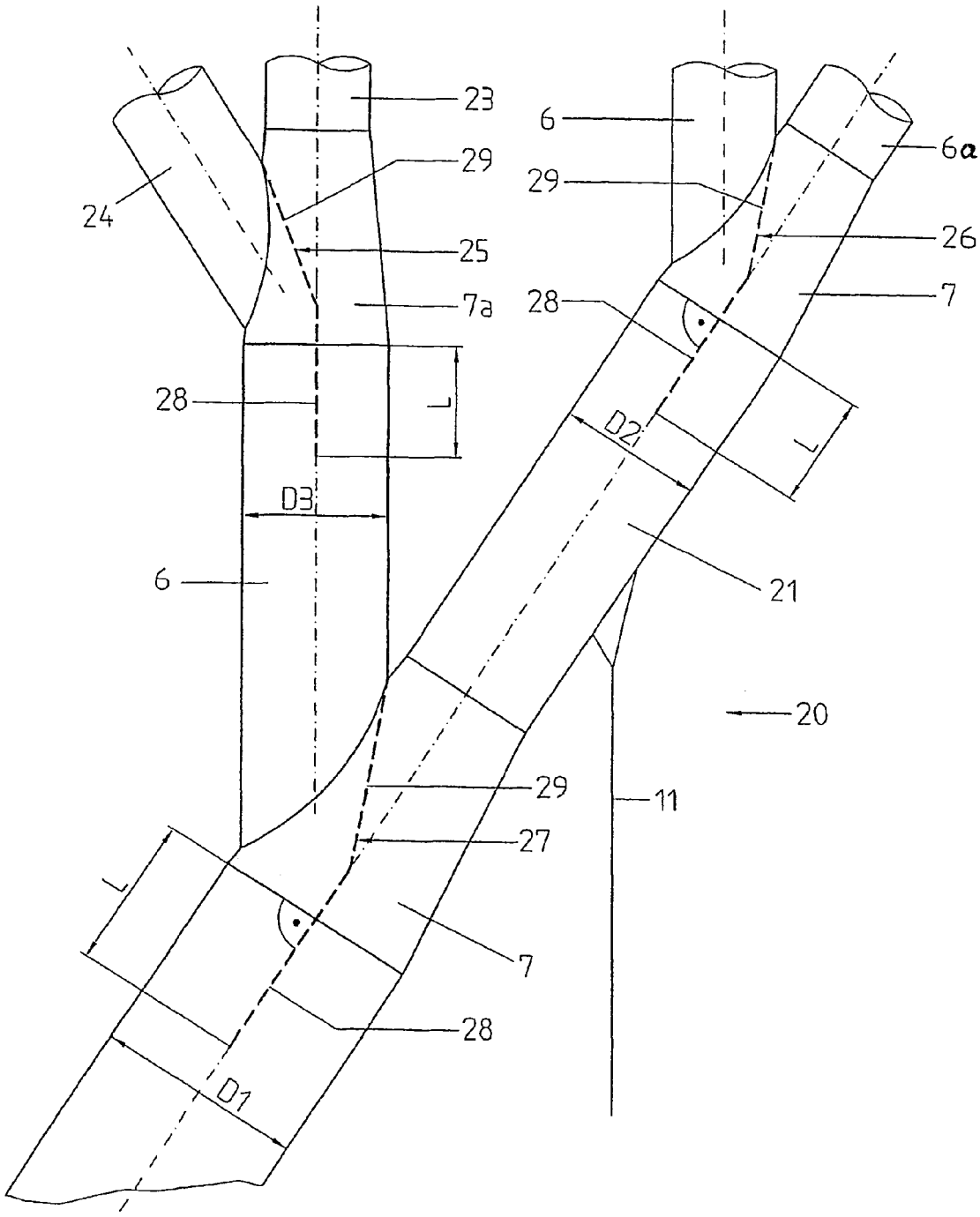
FIG. 8 is a schematic illustration, on an enlarged scale, of the exhaust steam pipeline of FIG. 7 with added integration of baffle plates.

FIG. 8 shows a schematic illustration, on an enlarged scale, of the exhaust steam pipeline 20 which is provided in addition with baffles plates 25, 26, 27 in the area of the connection zones 7, 7*a*. The baffle plates 25, 26, 27 are intended to split the exhaust steam flow in partial steam flows in correspondence to the ratio of distribution pipes that are connected to a connection zone 7, 7*a*. As shown in FIGS. 7 and 8, a total of four distribution pipes of the condenser elements are supplied with exhaust steam. Thus, the exhaust steam is split at each connection zone 7, 7*a* at a ratio of 1:1. The even split is realized by mounting the baffle plates 25, 26, 27 within the main steam line 21 or branch line 6, respectively, anteriorly of the connection zones 7, 7*a*. A circular cross section of the main steam line 21 or branch line 6 is thus split in two semi-circles. An area-based even split is provided, when the cross section of the main steam line 21 or branch line 6 deviates from a circular cross section. The respective baffle plates 25, 26, 27 are so configured as to realize an area-based even split anteriorly of the respective connection zones 7, 7*a* as well as in the area of the connection zones 7, 7*a*. The pressure drops of the partial exhaust steam flows in the area of the connection zones 7, 7*a* are almost identical and the amount of exhaust steam is split in identical portions.

The baffle plates 25, 26, 27 are shown here of angled configuration. The respectively leading length portion 28 of the baffle plates 25, 26, 27 has a length L which corresponds to the diameter D1, D2, D3 of the main steam line 21 and branch line 6, respectively, anteriorly of the connection zone 7, 7*a*. The connection zone 7, 7*a* begins as intersection of the longitudinal center axes of the respective branch line 6 with the main steam line 21 or as intersection of the partial line 24 with the first branch line 6. It can be seen that the straight course of the respectively leading length portions 28 of the baffle plates 25, 26, 27 extends beyond this intersection before the respectively trailing length portion 29 extends at an angle. The attachment point of the trailing length portion 29 is so selected that the flow cross sections are substantially identical in the area of the connection zones 7, 7*a*.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An exhaust-steam pipeline for a steam power plant, comprising a main steam line carrying exhaust steam and having at least two branch lines which are fluidly connected to respective condenser elements of the steam power plant and branch off from the main steam line at connection zones in spaced-apart relationship, said main steam line having a cross section, which decreases following each of the connection zones, and being constructed to ascend at an angle to a horizontal in flow direction of the exhaust steam.

2. The exhaust-steam pipeline of claim 1, wherein the angle ranges from 5° to 60°.

3. The exhaust-steam pipeline of claim 1, wherein the angle ranges from 10° to 20°.

4. The exhaust-steam pipeline of claim 1, and further comprising a center duct, wherein the main steam line has two main steam line portions which are connected to the center duct with opposing ascent.

5. The exhaust-steam pipeline of claim 1, and further comprising a support assembly for supporting the main steam line, said support assembly having compensation means for compensating thermal length changes of the main steam line.

6. The exhaust-steam pipeline of claim 5, wherein the compensation means includes a self-aligning mount or a sliding member.

7. The exhaust-steam pipeline of claim 1, wherein at least one of the branch lines ascends slantingly at an angle relative to the main steam line in flow direction of the exhaust steam.

8. The exhaust-steam pipeline of claim 1, wherein one of the branch lines is disposed at an outer end of the main steam line and has an orientation which corresponds to an orientation of the main steam line.

9. The exhaust-steam pipeline of claim 1, wherein at least one of the branch lines is split into at least two partial lines at a connection zone.

10. The exhaust-steam pipeline of claim 9, wherein at least one of the partial lines ascends slantingly at an angle in relation to the one of the branch lines.

11. The exhaust-steam pipeline of claim 1, and further comprising a baffle plate disposed in an area of at least one of the connection zones of the branch lines for splitting the flow of exhaust steam in partial streams.

12. The exhaust-steam pipeline of claim 9, and further comprising a baffle plate disposed in an area of the connection zone for splitting the flow of exhaust steam in partial streams.

13. The exhaust-steam pipeline of claim 11, and further comprising distribution pipes connected to the branch lines in one-to-one correspondence, wherein a ratio of partial steam flows corresponds to a ratio of distribution pipes following a connection zone.

14. The exhaust-steam pipeline of claim 13, and further comprising distribution pipes connected to the partial lines of the branch line in one-to-one correspondence, wherein a ratio of partial steam flows corresponds to a ratio of distribution pipes following the connection zone.

* * * * *